US008733043B1

(12) United States Patent
Cashman

(10) Patent No.: US 8,733,043 B1
(45) Date of Patent: May 27, 2014

(54) CORNER BLOCK BUILDING TRIM

(71) Applicant: Trim Solutions, LLC, East Hartford, CT (US)

(72) Inventor: Daniel J. Cashman, Suffield, CT (US)

(73) Assignee: Trim Solutions, LLC, East Windsor, CT (US)

( * ) Notice: Subject to any disclaimer, the term of this patent is extended or adjusted under 35 U.S.C. 154(b) by 0 days.

(21) Appl. No.: 13/827,481

(22) Filed: Mar. 14, 2013

(51) Int. Cl.
*E04B 2/00* (2006.01)

(52) U.S. Cl.
USPC ..... 52/287.1; 52/716.8

(58) Field of Classification Search
USPC ..... 52/58, 312, 519, 523, 525, 526, 287.1, 52/288.1, 459, 460, 461, 462, 465, 470, 52/471
See application file for complete search history.

(56) References Cited

U.S. PATENT DOCUMENTS

| | | | | |
|---|---|---|---|---|
| 2,616,131 | A * | 11/1952 | Gage | 52/276 |
| 7,228,665 | B2 * | 6/2007 | Perry | 52/287.1 |
| 7,654,050 | B2 * | 2/2010 | Justice | 52/288.1 |
| 2003/0226327 | A1 * | 12/2003 | Perry | 52/287.1 |
| 2010/0242387 | A1 * | 9/2010 | Cashman | 52/287.1 |

* cited by examiner

*Primary Examiner* — Jessica Laux
(74) *Attorney, Agent, or Firm* — Alix, Yale & Ristas, LLP

(57) ABSTRACT

A trim piece for attachment to either an outside or an inside corner of a building for subsequently receiving and hiding the ends of a frieze board or siding panels, thereby providing a neat, smooth corner transition. Two inner flat surfaces converge at right angles to form a primary inner corner for abutting conformance with the building corner, and two outer trim elements defining respective two outer flat decorative surfaces converge at right angles to form an outer corner. Two mounting flanges extend in parallel with the respective inner flat surfaces, and are spaced parallel to and extend laterally beyond a respective outer trim element. The flanges and outer trim elements form a pair of vertical slots for receiving a frieze board or at least one siding panel.

15 Claims, 8 Drawing Sheets

CORNER BLOCK BUILDING TRIM

BACKGROUND

The present invention relates to building trim and, in particular, to trim for the external and internal corners of a building exterior.

In the construction or renovation of buildings, decorative corner trim pieces can be installed on exterior or interior corners to simulate an exposed surface of a structural corner post. Such decorative trim pieces can be fabricated by a supplier and delivered to the building site for installation before or after the wall exterior siding, depending on the type of post to be simulated and whether the siding is wood or vinyl.

It is known to use cellular PVC as the raw material, because it can be purchased in the desired color, cut, and seam welded into intricate decorative designs.

With conventional corner posts and trims, the installer drills pilot holes for screwing or nailing the trim piece against the converging walls. A careful installer would try to minimize the visibility of the fastener penetrations but, especially with pre-colored posts, any touchup required after the installation adds to the labor cost of what should be a simple and straightforward installation.

U.S. Pat. No. 8,141,308 issued Mar. 27, 2012 for "Prefabricated Corner Post" describes an improvement whereby no holes for fastening to the building structure are required through any visible surface of the simulated corner post. The corner post described therein has a substantially uniform surface from top to bottom.

SUMMARY

The object of the present invention is to provide a trim system for an outside or inside corner of a building structure, which avoids the need for penetrating the visible surfaces of the trim piece during installation.

A general embodiment is directed to a trim piece for attachment to either an outside or an inside corner of a building for subsequently receiving and hiding the ends of a frieze board or siding panels, thereby providing a neat, smooth corner transition. Two inner flat surfaces converge at right angles to form a primary inner corner for abutting conformance with the building corner, and two outer trim elements defining respective two outer flat decorative surfaces converge at right angles to form an outer corner. Two mounting flanges extend in parallel with the respective inner flat surfaces, and are spaced parallel to and extend laterally beyond a respective outer trim element. The flanges and outer trim elements form a pair of vertical slots for receiving a frieze board or at least one siding panel.

The end of the received panel (such as frieze board or siding panel) has freedom to slide within the slot while remaining hidden, thereby accommodating temperature fluctuations.

Preferably, two or more corner trim pieces are vertically stackable along the full height of the building corner. A bottom corner block engages a bottom frieze board or the like, a middle corner block is stacked on the bottom block and engages a plurality of siding elements, and a top corner block engages a top frieze board or the like.

The bottom corner block has a cooperating horizontal bottom channel in fixed relationship to each wall, with each bottom channel having an end that is adjacent to a building corner. The bottom corner block has a body including two inner flat surfaces converging at right angles to form a bottom block primary inner corner and two outer trim elements defining respective two outer flat surfaces converging at right angles to form a bottom block outer corner. Two bottom primary mounting flanges are attached to the body, each extending from a respective inner flat surface in spaced parallel relationship to an outer trim element and attached to a respective wall at the building corner. Each primary mounting flange and a respective outer trim element form a respective vertical bottom slot aligned perpendicularly with a respective horizontal channel. In this manner, the frieze board is vertically supported by the bottom channel and has an end that is within the respective bottom slot and is covered by the respective outer trim element.

Preferably, the bottom corner block has an upper end comprising converging horizontal ledges that cover the upper ends of the bottom slot. A middle corner block has inner flat surfaces converging at right angles to form a middle block inner corner and two outer trim elements defining respective two outer flat surfaces converging at right angles to form a middle block outer corner. Middle mounting flanges extend from the inner flat surfaces in spaced parallel relationship to outer trim elements and are attached to the wall at the building corner. The flanges and trim elements form another pair of slots substantially vertically aligned with the slots in the bottom corner block, for receiving and covering the ends of siding panels.

According to another aspect, the present disclosure is directed to a trim piece configuration on the corner of a building where two walls meet. The arrangement comprises a horizontal bottom channel attached to the bottom of each wall, each channel having an end that is adjacent to a given building corner. A bottom corner block has a body including two bottom trim elements converging at two right angles to form a bottom trim corner and a bottom mounting flange extending from each bottom trim element. Each bottom flange attaches to a respective wall at the given corner such that each bottom trim element is adjacent an end of the bottom channel and is spaced from a wall, thereby forming a vertical bottom slot aligned perpendicularly with the channel. A frieze board is vertically supported by the bottom channel and has an end that is within the bottom slot and covered by the bottom trim element of the corner block.

From another aspect, the disclosure is directed to a method for installing at least one horizontal siding panel and a vertical corner trim on walls that converge at an exterior corner of a building. The steps include selecting at least one vertically extending corner block, each having two inner flat surfaces converging at right angles to form an inner corner, two outer trim elements defining respective two outer flat decorative surfaces converging at right angles to form an outer corner, and two mounting flanges, each extending in parallel to a respective inner flat surface, wherein each mounting flange extends in spaced parallel relationship laterally beyond a respective outer trim element and with said spaced outer trim element forms a respective vertical slot. The inner is placed against the building corner. The flanges are affixed onto the buildings walls, and one horizontal end of the panel is placed into a slot. The panels are then affixed to the wall or to each other.

BRIEF DESCRIPTION OF THE DRAWING

The salient features of the invention will be described in the accompanying drawing, in which.

DETAILED DESCRIPTION

Figure 1:
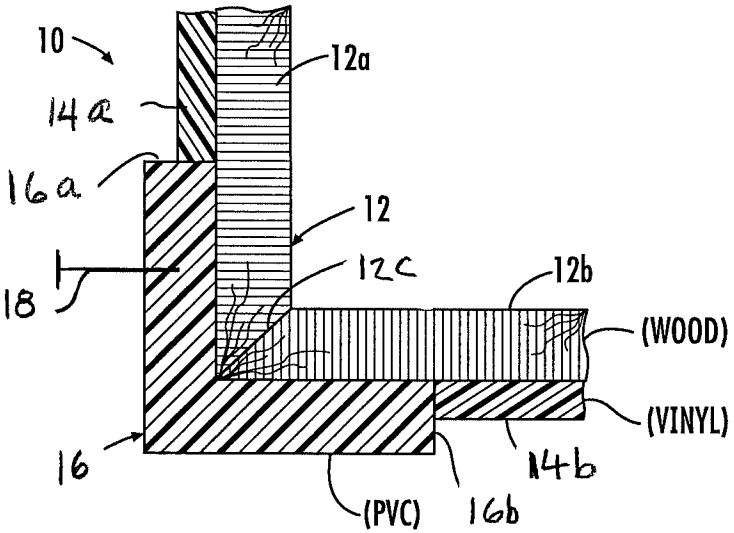
FIG. 1 PRIOR ART
FIG. 1 is a cross-sectional view of an external building corner with a corner trim piece according to conventional practice.

FIG. 1 is a schematic cross-sectional view of a building outside or external corner 10 in which the building structure or frame 12 has first and second walls 12*a*, 12*b*, forming a corner joint 12*c*, with the walls covered by respective siding panels 14*a*, 14*b*. The external corner where the walls and siding meet is covered by the decorative corner trim piece 16 in a conventional manner. The side edges 16*a*, 16*b* of the trim piece receive respective abutting siding panels 14*a*, 14*b*. If no space or gap is provided, thermal expansion can be a problem. If a gap is provided, the appearance suffers. Nails or screws 18 pass through the outer, visible surface of the trim piece 16 to penetrate the wall 12, and must be cosmetically treated.

Figure 2:
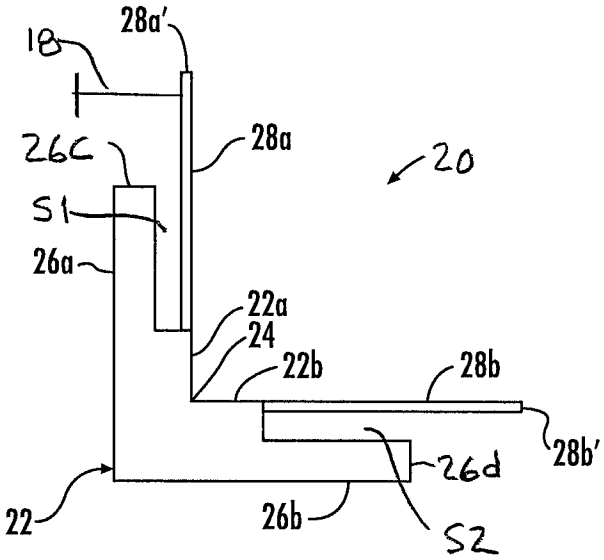
FIG. 2 is top view of a representative corner trim piece according to an aspect of the present invention, usable in the context shown in FIG. 1.

FIG. 2 shows the components that constitute a trim piece 20 according to an aspect of the present invention, providing an improvement to the trim piece 16 that avoids nails or screws through the visible surface of the trim piece. The body 22 includes two vertically extending inner flat elements or surfaces 22*a*, 22*b* that converge at right angles to form an inner corner 24. A corresponding pair of outer flat trim elements 26*a*, 26*b* extends at right angles to form an outer corner. Respective mounting flanges 28*a*, 28*b* extend from the body 22 flush with the surfaces of inner corner 24 in parallel with and spaced from the outer trim elements 26*a*, 26*b* whereby the confronting surfaces of 26*a*, 28*a*, form a first vertical slot S1 and likewise the confronting surfaces of 26*b* and 28*b* form another vertical slot S2. The lateral edges 28*a*' and 28*b*' of the flanges extend beyond the lateral edges 26*c* and 26*d* of the trim elements 26*a*, 26*b*.

In the present description, "inside corner" and "outside corner" should be understood as concave and convex convergence of building walls, respectively, whereas "inner corner" and "outer corner" should be understood as referring to the hidden corner of the trim piece that abuts the corner of the building and the visible corner of the trim piece, respectively.

The width of the respective slots corresponds to the width of the siding elements (such as 14*a* and 14*b* shown in FIG. 1). After the trim piece 20 is attached to the corner of building 12 via fasteners 18 passing through the laterally extended portions of flanges 28*a* and 28*b* against walls 12*a*, 12*b* in any known manner, the ends of siding panels 14*a*, 14*b* can be slid laterally through the respective slots S1 and S2 to be overlapped by the decorative trim elements 26*a*, 26*b*. Thus, the fasteners 18 are hidden by the siding panels 14*a*, 14*b* and the installer need not trim the ends of the siding panels for abutment against the trim elements 26*a*, 26*b*.

Figure 3:
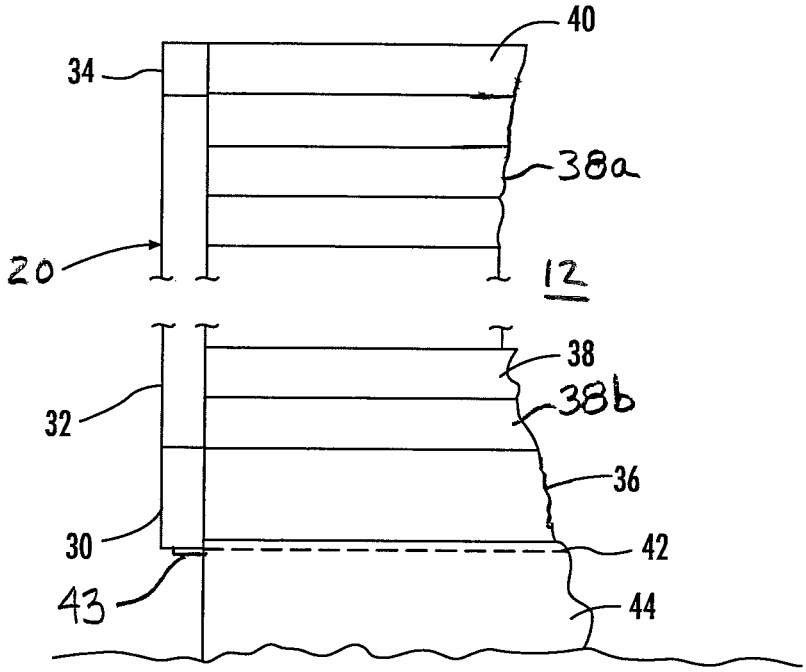
FIG. 3 is an elevation view of a portion of one wall at the outside corner of a building, showing a bottom frieze board and associated bottom corner block, a plurality of siding panels and associated middle corner block, and a top frieze board with associated top corner block, in accordance with another aspect of the invention.

FIGS. 1 and 2 provide the context for the implementations shown in FIG. 3-8. FIG. 3 shows an elevation view taken from the side of a building at an external corner in which a composite trim piece system 20 comprises a bottom corner block 30, a middle corner block 32 which rests on the bottom corner block 30, and a top corner block 34 which preferably overlaps the front of but does not bear on the middle corner block 32. A frieze board 36 is captured by the bottom corner block 30, a series of vertically interconnected siding panels 38 are captured by the middle corner block 32, and a top frieze board or the like 40 is captured by the top corner block 34. As a point of reference, individual siding elements such as 38*a* in FIG. 3 correspond to the siding element 14*b* shown in FIG. 1, but in slot S2 of a trim piece 20 of the type shown in FIG. 2.

Figure 4:
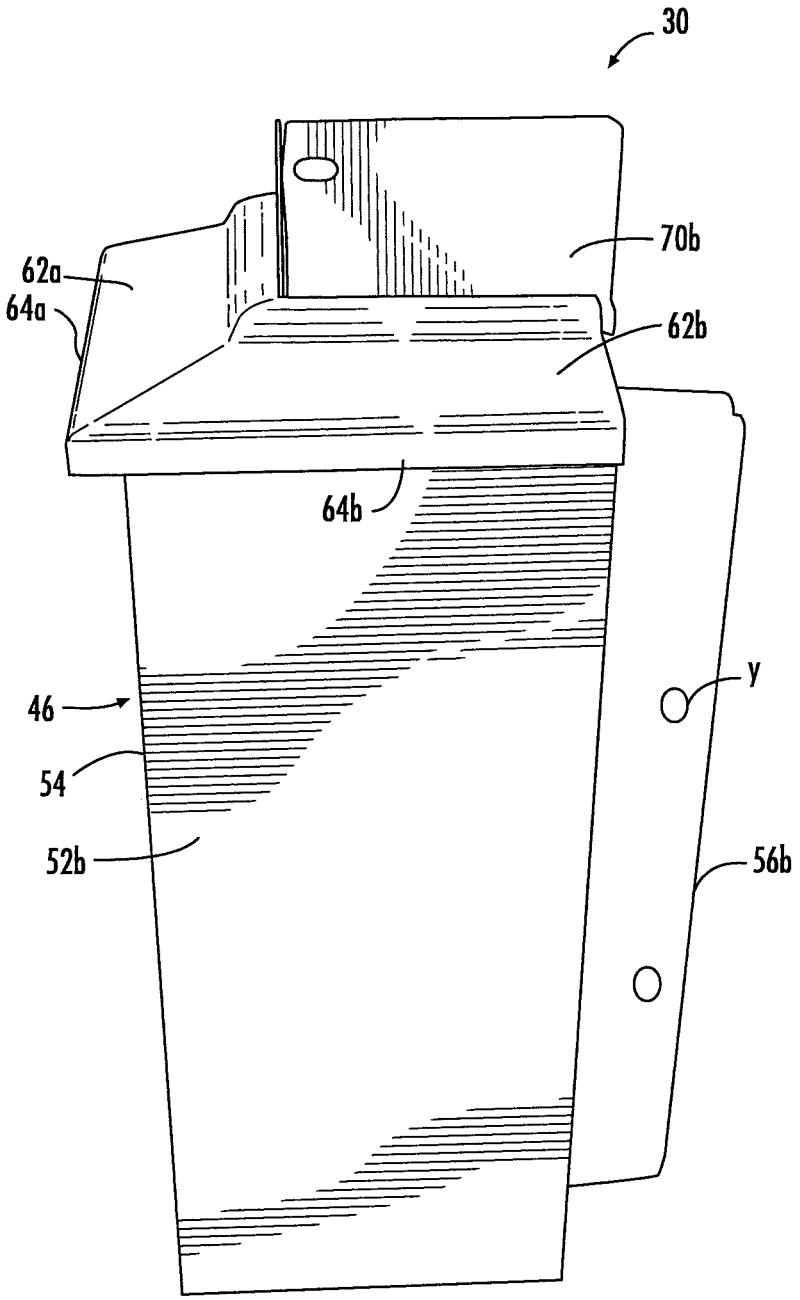
FIG. 4 is an oblique, partial front view of a bottom corner block.
Figure 5A:
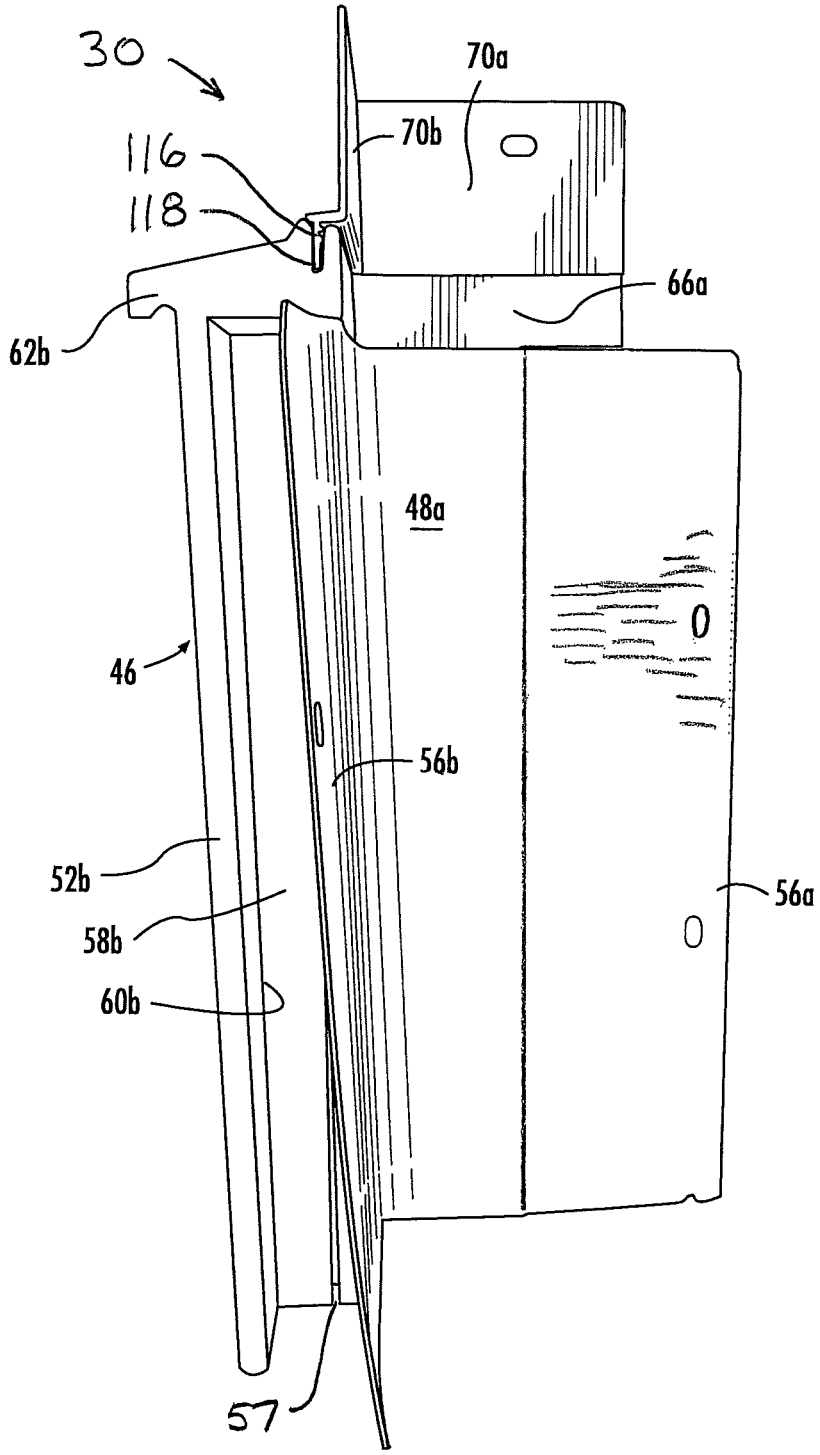
FIGS. 5A and 5B are elevation views taken from the right side and back of the bottom corner block of FIG. 4.
Figure 5B:
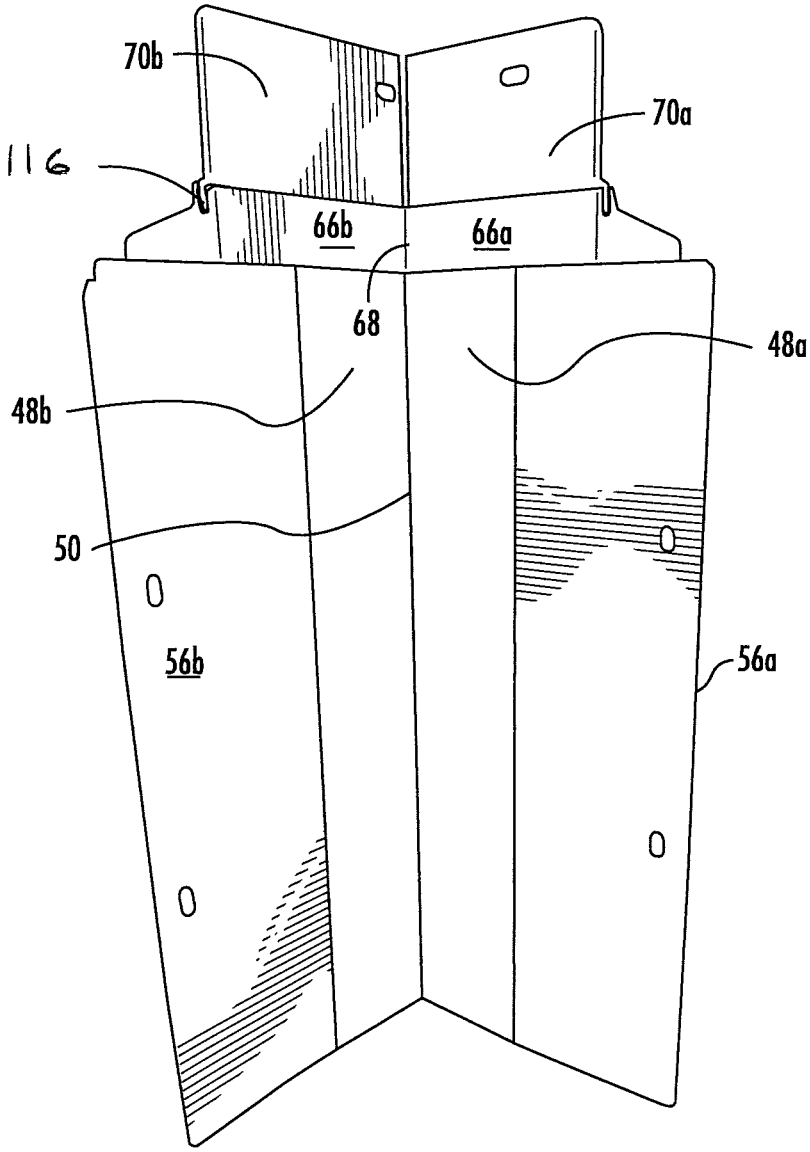

FIGS. 4-5 show various views of the bottom corner block 30. With reference to FIGS. 3-5, the frieze board 36 is vertically supported by a bottom channel or strip 42 attached to or formed in the bottom of each wall at the elevation where the bottom edge of frieze board 36 travels horizontally on or against the wall or building foundation 44. As will be explained further below, the bottom edge of the frieze board 36 is vertically supported in the channel 42 and extends into a vertical slot 46 in the bottom corner block 30.

The bottom corner block 30 has a body 46 including two inner flat surfaces 48*a*, 48*b* converging at right angles to form a bottom block primary inner corner 50 and two outer trim elements 52*a*, 52*b* defining respective two outer flat surfaces converging at right angles to form a bottom block outer corner 54. Two bottom primary mounting flanges 56*a*, 56*b* are attached to the body, each extending from a respective inner flat surface 48*a*, 48*b* in spaced parallel relationship to an outer trim element 52*a*, 52*b* and attached to a respective wall at the building corner. Each primary mounting flange and a respective inner surface of an outer trim element form a respective vertical bottom slot 60*b* aligned perpendicularly with a respective horizontal bottom channel 42. In this manner, the frieze board 36 is vertically supported by the bottom channel 42, has an end that is within the respective bottom slot 60*a* or 60*b*, and is covered by the respective outer trim element 52*a*, 52*b*.

During installation of the overall corner trim arrangement 20, first the bottom channel 42 and bottom corner block 30 are attached to the building and/or wall and then the frieze board 36 is slid along bottom channel 42 until the leading end is within the vertical slot 60*b* of the bottom corner block and thus is covered by the bottom trim element 52*b* with no mating edges required or visible.

The bottom slot 60*b* is defined in part by a vertical stop surface 58*b* hidden by the bottom trim element 52*b* and perpendicularly aligned with the channel 42. The lower edge of the frieze board slides along the bottom channel 42 toward stop surface 58*b*, until the end of the frieze board extends vertically within the bottom slot 60*b* yet remains spaced from the stop surface 58*b* by a distance that can accommodate thermal expansion. Thereafter, the frieze board is preferably attached to the wall with fastening means that can accommodate expansion and contraction. For example, the frieze board flange can extend vertically along the back of the board, beyond the upper edge, and fastening means can be advanced through a plurality of horizontally spaced, horizontally elongated holes in the board flange into the wall. The frieze board flange and fasteners will be covered by the siding panel 38*b*. A teaching for facilitating this technique is described in U.S. Pat. No. 8,347,583 issued Jan. 8, 2013 for "Building Trim", the disclosure of which is hereby incorporated by reference.

Importantly, the leading edge of the frieze board 36 in the slot 60*b* can shift horizontally within the vertical slot 60*b* without stressing either the bottom corner block 30, the frieze board 36 or the bottom channel 42 because there is no fixed connection between the frieze board 36 and the bottom corner block 30.

Preferably, the mounting flanges 56*a*, 56*b* have flexible or resilient inner edges that are attached to a vertical groove in the stop surface or wall 58*a*, 58*b*. Most preferably, each stop surface 58*a*, 58*b* has two vertically extending grooves and the flange has a vertical edge that is attachable to either of the grooves, thereby selectively defining either of two widths for the vertical slots 60*a*, 60*b*. One such groove is shown at 57, where the bottom of the flange has been bent for clarity.

The trim elements 52*a*, 52*b* have upper and lower ends at the upper and lower ends of the slots 60*a*, 60*b*. Converging horizontal ledges 62*a*, 62*b* at the upper ends of the trim elements cover the upper ends of the slots 60*a*, 60*b*, and have outer edges 64*a*, 64*b* that project beyond the flat surfaces of the outer trim elements 52*a*, 52*b*, and inner edges or surfaces 66*a*, 66*b* that form a secondary inner corner 68 for abutting conformance with the building. The ledges 62*a*, 62*b* overhang the trim elements 52*a*, 52*b* and can provide a bearing surface for the next higher middle corner block 32.

A secondary mounting flange 70*a*, 70*b* projects vertically from each ledge 62*a*, 62*b* in vertical alignment with the inner surfaces 66*a*, 66*b* of the secondary inner corner 68. The secondary flanges extend laterally for attachment to the two sides of the corner of the building wall. The respective surfaces of the primary inner corner 48*a*, 48*b*, the primary mounting flange 56*a*, 56*b*, the secondary inner corner 66*a*, 66*b* and the secondary mounting flange 70*a*, 70*b* are substantially coplanar for intimately conforming with the outside corner of the building wall.

Figure 6:
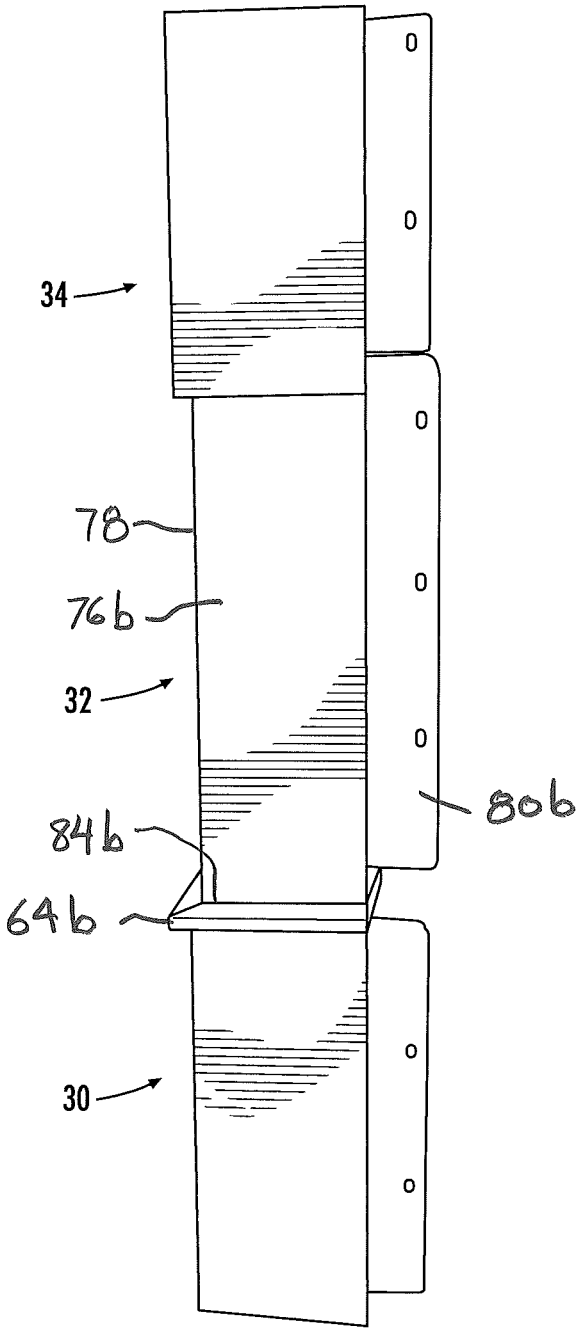
FIG. 6 shows stacked bottom, middle, and top corner blocks in a preferred configuration having a decorative relationship of the visible elements.
Figure 7:
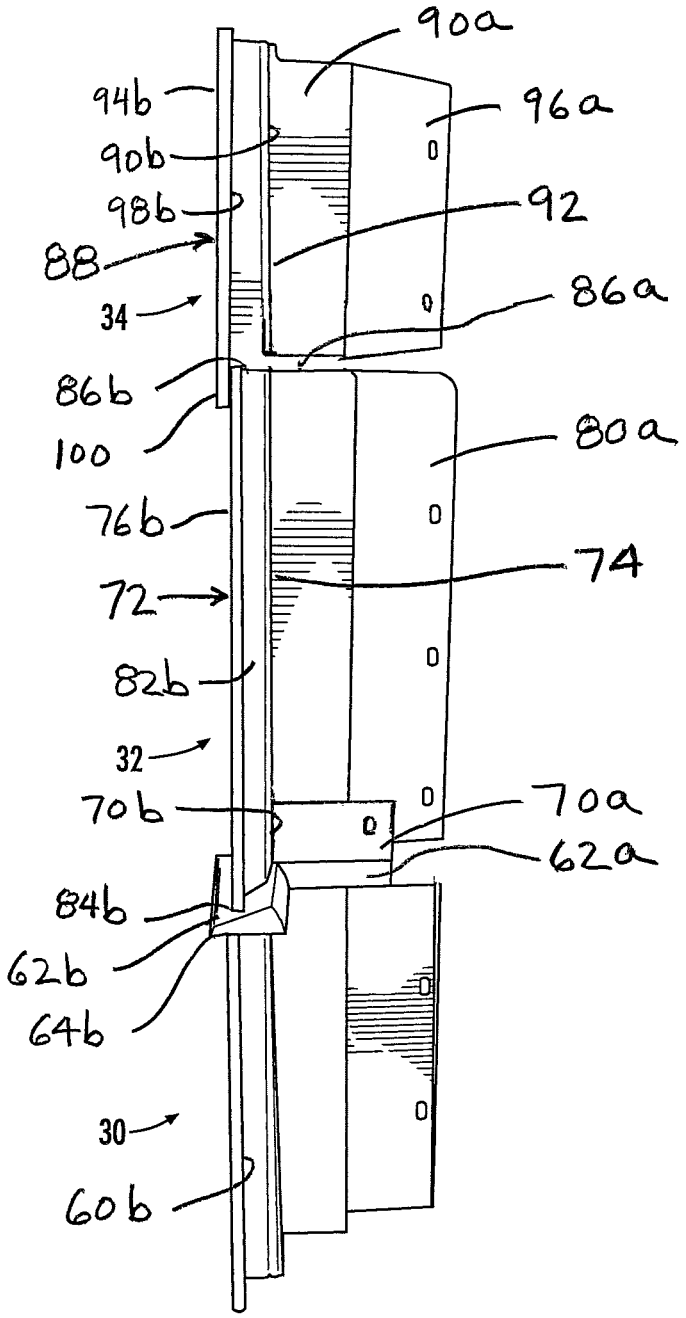
FIG. 7 is a side view of the stacked corner blocks shown in FIG. 6.

The secondary flanges 70*a*, 70*b* of the bottom corner block 30 create an exterior angle relative to the ledges 62*a*, 62*b*. After both the primary and secondary flanges of the bottom corner block have been attached to the walls, the middle corner block is placed over the outside of the secondary flanges 70*a*, 70*b* with the bottom of the middle corner block 32 resting on the ledges 62*a*, 62*b*, as shown in FIGS. 3, 6, and 7. The middle corner block 32 features a body 72 including two inner flat surfaces converging at right angles to form a middle block inner corner 74 and two outer trim elements 76*a*, 76*b* defining respective two outer flat surfaces converging at right angles to form a middle block outer corner 78. Two middle block mounting flanges 80*a*, 80*b* are attached to the body, each extending from a respective inner flat surface in spaced parallel relationship to an outer trim element 76*a*, 76*b* and attached to a respective wall at the building corner. Each mounting flange 80*a*, 80*b* and a respective outer trim element form a respective vertical middle block slot 82*a*, 82*b* substantially vertically aligned with the bottom slot 60*a*, 60*b* in the bottom corner block 30. At least one middle siding panel 38 is attached to a wall, has an end that is within the middle slot 82*a*, 82*b*, and is covered by the middle outer trim element 76*a*, 76*b*.

Preferably, the ledge 62*a*, 62*b* on the bottom corner 30 block has a top surface that is angled downwardly and outwardly to the outer edge 64*a*, 64*b* and the middle trim element 32 has a bottom edge 84*a*, 84*b* that is angled downwardly and outwardly for conforming abutment with the top surface of the ledge of the bottom corner block 30. As a further preference, the outer trim element 76*a*, 76*b* of the middle corner block 32 is recessed with respect to the outer edge 64*a*, 64*b* of the ledge of the bottom corner block 30.

As also shown in FIGS. 3, 6 and 7 a top corner block 34 fits over the middle corner block 32, preferably with a space or gap "g" from the upper transverse surfaces 86*a*, 86*b* at the upper ends of the slots 82*a*, 82*b* of the middle corner block 32, by a distance sufficient to accommodate thermal expansion of the middle corner block 32. Whereas the top and bottom corner blocks 34, 30 would typically have a height of less than one foot, e.g., generally about eight inches, the middle corner block 32 would have a height in the range of 8-20 feet. The middle corner block 32 can rest on the bottom corner block because only one end (at 86*a*, 86*b*) needs to be free to expand, i.e., within the top block.

The top corner block 34 has a body 88 including two inner flat surfaces 90*a*, 90*b* converging at right angles to form a top block inner corner 92 and two outer trim elements 94*a*, 94*b* defining respective two outer flat surfaces converging at right angles to form a top block outer corner. Two top mounting flanges 96*a*, 96*b* are attached to the body, each extending from a respective inner flat surface 90*a*, 90*b* in spaced parallel relationship to the inner surface of an outer trim element 94*a*, 94*b* and attached to a respective wall at the building corner. Each mounting flange 96*a*, 96*b* and a respective outer trim element 90*a*, 90*b* form a respective top slot 98*a*, 98*b* that would substantially vertically align with the slots 82*a*, 82*b* in the middle corner block 32. More importantly, the respective inner corners 92 and 74 should vertically align.

Middle slots 82*a*, 82*b* are generally sized at about ¾ inch to accommodate standard siding thickness whereas top slots 98*a*, 98*b* (and bottom slots 60*a*, 60*b*) are generally sized at about one inch to accommodate standard frieze board thickness. A top frieze board 40 is slid into a slot 98*a*, 98*b* and attached to the wall, preferably with a free end within the slot and covered by the top outer trim element 94*a*, 94*b*. Preferably, each outer trim element of the top corner block extends vertically below and partially covers the outer trim elements of the middle corner block, as at 100.

It should be appreciated that, with a length of up to 20 feet, the middle corner block 32 can be quite heavy. The middle corner block 32 can find vertical support during installation while resting on the ledges of the previously installed bottom corner block 30, because block 30 has been attached to the walls with nails through the flanges. However, this support can be increased, particularly for lengthy corner blocks, by affixing brackets 43 to the wall or foundation, which extend to the lower edge of the body of the bottom corner block, thereby enhancing the resistance to vertical loads.

Figure 8:
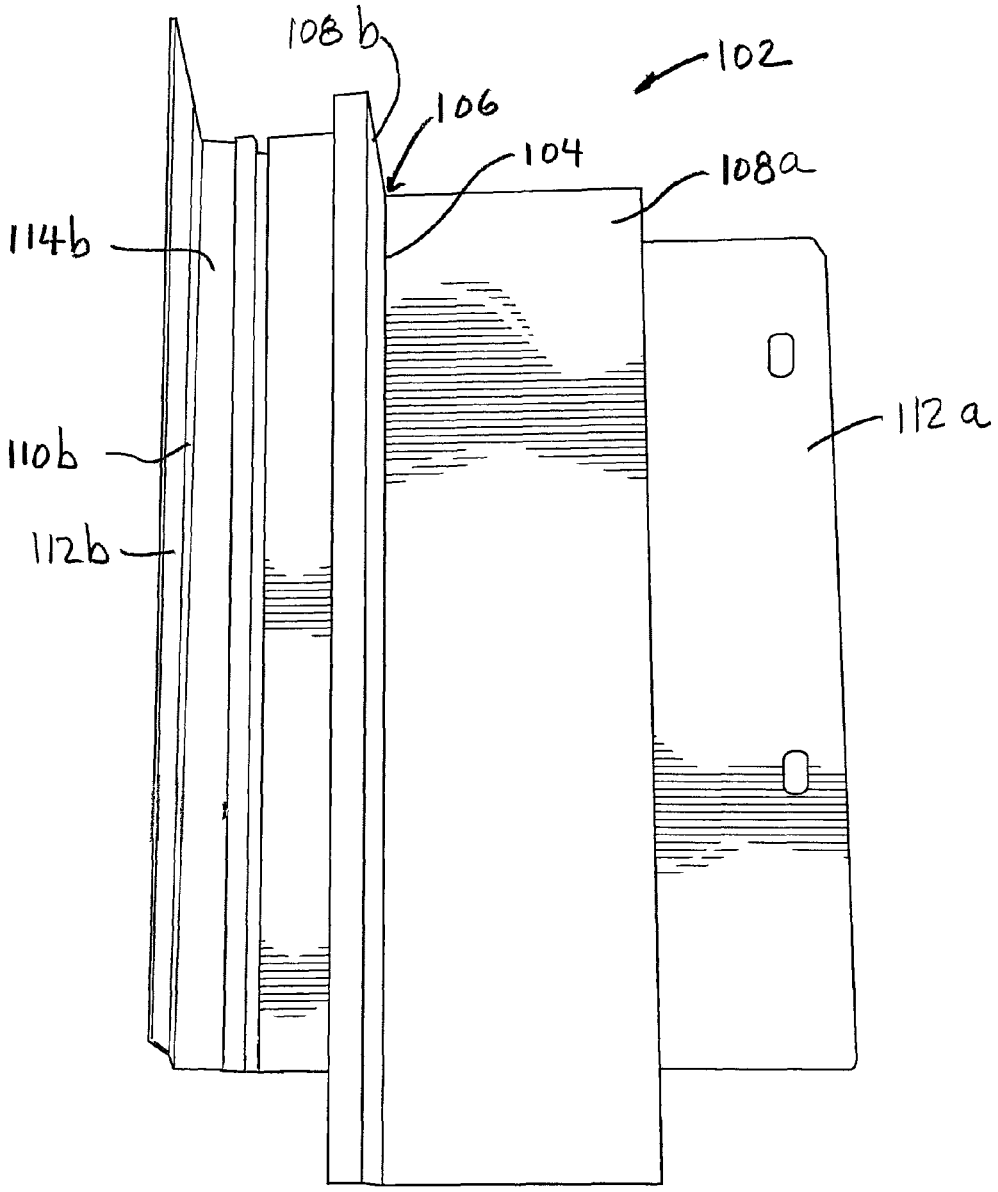
FIG. 8 is a partial front view of a corner block suitable for attachment to the inside corner of a building wall.

FIG. 8 shows a middle corner block 102 suitable for attachment to the inside corner of a building wall. One of ordinary skill in this field can readily adapt the concepts described above to providing bottom and top corner blocks for use with the inside corner block shown in FIG. 8. In general, however, the inside corner blocks would most often provide a uniform profile along the full height of the building inside corner.

The inside corner block 102 has a corner configuration with an outer corner 104 having a 90 degree included angle that is visible to an observer and a corresponding inner corner (not visible in FIG. 8) having a 270 degree angle that is attached to the inside corner of a building wall. The inside corner block 102 features a body 106 including two trim elements having outer flat surfaces 108*a*, 108*b* converging at right angles to form the block outer corner 104 and two inner elements (only 110*b* is visible) defining respective two inner flat surfaces converging at right angles to form the block inner corner. Two mounting flanges 112*a*, 112*b* are attached to the body, each extending from a respective inner flat surface of the inner elements in spaced parallel relationship to an outer trim element 108*a*, 108*b* and attachable to a respective wall at the building inside corner. Each mounting flange 112*a*, 112*b* and a respective outer trim element 108*a*, 1098*b* form a respective vertical slot (only 114*b* is visible). At least one panel is attached to a wall, has an end that is within slot such as 114*b*, and is covered by an outer trim element 108*a*, 108*b*.

In all the corner blocks, the primary and secondary flanges are preferably secured in place as shown in FIG. 5A, whereby a flexible but striated or otherwise irregular tab 116 or the like along one edge of a flange, is friction fit into a groove 118 on the body of the block.

It should be appreciated that in some circumstances only one trim piece could span the full vertical length of an outside or inside corner of a building wall. As noted previously, such a trim piece can be quite heavy, up to 400 pounds, and become very unwieldy during installation, especially if a bottom block is not used. If no bottom corner block is to be used, a corner bracket as indicated at 43 in FIG. 3 is extremely helpful.

What is claimed:

1. A trim arrangement on the corner of a building where two walls meet, comprising:

a horizontal bottom channel in fixed relationship to each wall, each bottom channel having an end that is adjacent to a building corner;

a bottom corner block having a body including two inner flat surfaces converging at right angles to form a bottom block primary inner corner and two outer trim elements defining respective two outer flat surfaces converging at right angles to form a bottom block outer corner;

two bottom primary mounting flanges attached to the body, each extending from a respective inner flat surface in spaced parallel relationship to an outer trim element and attached to a respective wall at said building corner;

whereby each primary mounting flange and a respective outer trim element form a respective vertical bottom slot aligned perpendicularly with a respective bottom channel; and a frieze board vertically supported by a bottom channel and having an end that is within the respective bottom slot and is covered by the respective outer trim element, wherein the bottom slot has upper and lower ends;

the bottom corner block has an upper end comprising converging horizontal ledges that completely cover the upper ends of the bottom slot, a middle corner block rests on the ledges of the bottom corner block, said middle corner block having a middle block body including two inner flat surfaces converging at right angles to form a middle block inner corner and two outer trim elements defining respective two outer flat surfaces converging at right angles to form a middle block outer corner;

two middle block mounting flanges attached to the middle block body, each extending from a respective inner flat surface in spaced parallel relationship to an outer trim element and attached to a respective wall at said building corner;

whereby each middle block mounting flange and a respective outer trim element form a respective vertical middle slot substantially vertically aligned with the bottom slot in the bottom corner block; and at least one middle siding panel attached to a wall, has an end that is within said middle slot and is covered by the middle outer trim element.

2. The trim arrangement of claim 1, wherein, a secondary mounting flange projects vertically from each ledge of the bottom corner block along the inner corner of the middle corner block, and is attached to a respective wall; and the middle corner block resting on the ledges, hides the secondary mounting flange of the bottom corner block.

3. The trim arrangement of claim 2, wherein the secondary flange extends in vertical alignment with the inner flat surfaces of the bottom corner block.

4. The trim arrangement of claim 3, wherein the inner flat surface of the bottom corner block, the primary mounting flange of the bottom corner block, and the secondary mounting flange are substantially coplanar.

5. The trim arrangement of claim 1, wherein each ledge has a top surface that is angled downwardly and outwardly to an outer edge that extends beyond the outer trim element; and the middle trim element has respective bottom edges that are angled downwardly and outwardly for conforming abutment with the top surface of the ledges of the bottom corner block.

6. The trim arrangement of claim 5, wherein the outer trim element of the middle corner block is recessed with respect to the outer edge of the ledges of the bottom corner block.

7. The trim arrangement of claim 1, wherein the middle slot has upper and lower ends;

a top corner block is situated above the middle corner block, said top corner block having a body including two inner flat surfaces converging at right angles to form a top block inner corner and two outer trim elements defining respective two outer flat surfaces converging at right angles to form a top block outer corner;

two top mounting flanges attached to the body, each extending from a respective inner flat surface in spaced parallel relationship to an outer trim element and attached to a respective wall at said building corner;

whereby each mounting flange and a respective outer trim element form a respective vertical top slot substantially vertically aligned with the middle slot in the middle corner block; and a frieze board or siding panel attached to a wall, has an end that is within said top slot and is covered by the top outer trim element.

8. The trim arrangement of claim 7, wherein the middle corner block has an upper transverse surface at the upper end;

the top corner block has a lower transverse surface that is spaced above the transverse surface at the upper end of the middle corner block; and the outer trim element of the top corner block extends vertically below and partially covers the outer trim element of the middle corner block.

9. A trim piece for attachment to a building corner, comprising:

two inner flat surfaces converging at right angles to form an inner corner for abutting conformance with the building corner;

two outer trim elements defining respective two outer flat decorative surfaces converging at right angles to form an outer corner;

two mounting flanges, each extending in parallel to a respective inner flat surface;

wherein each mounting flange extends in spaced parallel relationship laterally beyond a respective outer trim element and with said spaced outer trim element forms a respective vertical slot;

the outer trim elements have upper and lower ends at upper and lower ends of the slot;

converging horizontal ledges at the upper ends of the outer trim elements cover the upper ends of the slots, and have outer edges that project beyond the flat surfaces of the outer trim elements and inner edges that form a distinct secondary inner corner for abutting conformance with the building; and a distinct secondary mounting flange projects vertically from each ledge in vertical alignment with the inner edges of the secondary inner corner.

10. The trim piece of claim 9, wherein each slot has a vertical stop surface hidden by the outer trim element.

11. The trim piece of claim 10, wherein each mounting flange has a vertical edge that is attached to a groove in the stop surface.

12. The trim piece of claim 10, wherein each mounting flange extends laterally flush with the flat surface of the inner corner.

13. The trim piece of claim 10, wherein the stop surface has two vertically extending grooves and each mounting flange has a vertical edge that is attachable to either of the grooves, thereby selectively defining either of two widths for the vertical slot.

14. The trim piece of claim 9, wherein the inner corner, the primary mounting flange, the secondary inner corner and the secondary mounting flange are coplanar.

15. The trim piece of claim 9, wherein the inner corner is concave and is attached to an outside corner of a building wall; and wall siding panels are received in said slot and attached to the wall.

* * * * *